US007999756B2

(12) United States Patent
Worl et al.

(10) Patent No.: US 7,999,756 B2
(45) Date of Patent: Aug. 16, 2011

(54) WIDEBAND ANTENNA ARRAY

(75) Inventors: Robert T. Worl, Renton, WA (US); Gary A. Ray, Issaquah, WA (US)

(73) Assignee: The Boeing Company, Chicago, IL (US)

( * ) Notice: Subject to any disclaimer, the term of this patent is extended or adjusted under 35 U.S.C. 154(b) by 758 days.

(21) Appl. No.: 12/040,432

(22) Filed: Feb. 29, 2008

(65) Prior Publication Data

US 2009/0219221 A1 Sep. 3, 2009

(51) Int. Cl.
*H01Q 21/00* (2006.01)

(52) U.S. Cl. ..... 343/893

(58) Field of Classification Search ..... 343/893, 343/725, 785, 900, 772
See application file for complete search history.

(56) References Cited

U.S. PATENT DOCUMENTS

| | | | | |
|---|---|---|---|---|
| 5,557,291 | A * | 9/1996 | Chu et al. | 343/725 |
| 6,552,691 | B2 * | 4/2003 | Mohuchy et al. | 343/770 |
| 6,650,291 | B1 * | 11/2003 | West et al. | 342/371 |
| 6,714,169 | B1 * | 3/2004 | Chau et al. | 343/876 |
| 7,012,572 | B1 * | 3/2006 | Schaffner et al. | 343/725 |
| 7,180,457 | B2 * | 2/2007 | Trott et al. | 343/770 |
| 2003/0214452 | A1 * | 11/2003 | Ippolito | 343/797 |
| 2005/0007286 | A1 * | 1/2005 | Trott et al. | 343/770 |
| 2006/0038732 | A1 * | 2/2006 | DeLuca et al. | 343/754 |

FOREIGN PATENT DOCUMENTS

| | | |
|---|---|---|
| EP | 0744787 | 11/1996 |
| JP | 2000196344 | 7/2000 |
| WO | WO 2005/015687 | 2/2005 |

OTHER PUBLICATIONS

Search Report from UK Intellectual Property Office on co-pending UK application (GB0902427.4) dated Jun. 3, 2009.

* cited by examiner

*Primary Examiner* — Huedung Mancuso
(74) *Attorney, Agent, or Firm* — Yee & Associates, P.C.

(57) ABSTRACT

A wideband antenna array including a plurality of antenna element cards. In certain embodiments the cards include a plurality of first radiators and a plurality of second radiators. The first radiators operate in a low band portion of the array's operating spectrum, and the second radiators operate in a high-band portion of the array's operating spectrum. In certain other embodiments at least one of the cards includes a pair of radiators. The radiators in the pair are oriented in substantially opposite directions. In certain other embodiments a first plurality of the antenna element cards includes at least a first radiator, a second radiator and electronics for controlling both the first and second radiators. A second plurality of the antenna element cards includes at least a first radiator, a second radiator and electronics for controlling only one of the first and second radiators.

21 Claims, 6 Drawing Sheets

384 Element Vivaldi Array d = (0.328" x 2)

| Frequency (GHz) | Element Gain (dB) | Array Gain (dB) | Element Factor Gain (dimensionless) | Array Factor Gain (dimensionless) | Absolute Array Gain (dimensionless) | Absolute Array Gain (dB) | Frequency (GHz) |
|---|---|---|---|---|---|---|---|
| 1 | -1.0 | 19.3 | 0.89 | 9.25 | 8.2 | 18.323 | 1 |
| 2 | 0.0 | 22.3 | 1.00 | 13.08 | 13.1 | 22.329 | 2 |
| 3 | 0.5 | 24.1 | 1.06 | 16.01 | 17.0 | 24.587 | 3 |
| 4 | 1.0 | 25.3 | 1.12 | 18.48 | 20.7 | 26.336 | 4 |
| 5 | 1.5 | 26.3 | 1.19 | 20.66 | 24.6 | 27.804 | 5 |
| 6 | 2.0 | 27.1 | 1.26 | 22.64 | 28.5 | 29.096 | 6 |

68

74

768 Element Vivaldi Array d = 0.328"

| Frequency ($GH_z$) | Element Gain (dB) | Array Gain (dB) | Element Factor Gain (dimensionless) | Array Factor Gain (dimensionless) | Absolute Array Gain (dimensionless) | Absolute Array Gain (dB) | Frequency ($GH_z$) |
|---|---|---|---|---|---|---|---|
| 7 | -4.0 | 27.8 | 0.63 | 24.45 | 15.4 | 23.764 | 7 |
| 8 | -3.0 | 28.3 | 0.71 | 26.14 | 18.5 | 25.345 | 8 |
| 9 | -2.0 | 28.9 | 0.79 | 27.72 | 22.0 | 26.856 | 9 |
| 10 | -1.0 | 29.3 | 0.89 | 29.22 | 26.0 | 28.314 | 10 |
| 11 | 0.0 | 29.7 | 1.00 | 30.65 | 30.6 | 29.728 | 11 |
| 12 | 1.0 | 30.1 | 1.12 | 32.01 | 35.9 | 31.106 | 12 |
| 13 | 2.0 | 30.5 | 1.26 | 33.32 | 41.9 | 32.453 | 13 |
| 14 | 3.0 | 30.8 | 1.41 | 34.57 | 48.8 | 33.774 | 14 |
| 15 | 3.3 | 31.1 | 1.45 | 35.78 | 52.0 | 34.324 | 15 |
| 16 | 3.5 | 31.4 | 1.50 | 36.96 | 55.3 | 34.854 | 16 |
| 17 | 3.8 | 31.6 | 1.54 | 38.10 | 58.7 | 35.368 | 17 |
| 18 | 4.0 | 31.9 | 1.58 | 39.20 | 62.1 | 35.866 | 18 |

70

78

768 Element Vivaldi Array

| Frequency ($GH_z$) | Element Gain (dB) | Array Gain (dB) | Element Factor Gain (dimensionless) | Array Factor Gain (dimensionless) | Absolute Array Gain (dimensionless) | Absolute Array Gain (dB) |
|---|---|---|---|---|---|---|
| 1 | -20.4 | 19.3 | 0.10 | 9.25 | 0.9 | -1.067 |
| 2 | -14.4 | 22.3 | 0.19 | 13.08 | 2.5 | 7.959 |
| 3 | -10.8 | 24.1 | 0.29 | 16.01 | 4.6 | 13.247 |
| 4 | -8.3 | 25.3 | 0.38 | 18.48 | 7.1 | 16.996 |
| 5 | -6.4 | 26.3 | 0.48 | 20.66 | 9.9 | 19.894 |
| 6 | -4.8 | 27.1 | 0.57 | 22.64 | 13.0 | 22.276 |
| 7 | -4.0 | 27.8 | 0.63 | 24.45 | 15.4 | 23.764 |
| 8 | -3.0 | 28.3 | 0.71 | 26.14 | 18.5 | 25.345 |
| 9 | -2.0 | 28.9 | 0.79 | 27.72 | 22.0 | 26.856 |
| 10 | -1.0 | 29.3 | 0.89 | 29.22 | 26.0 | 28.314 |
| 11 | 0.0 | 29.7 | 1.00 | 30.65 | 30.6 | 29.728 |
| 12 | 1.0 | 30.1 | 1.12 | 32.01 | 35.9 | 31.106 |
| 13 | 2.0 | 30.5 | 1.26 | 33.32 | 41.9 | 32.453 |
| 14 | 3.0 | 30.8 | 1.41 | 34.57 | 48.8 | 33.774 |
| 15 | 3.3 | 31.1 | 1.45 | 35.78 | 52.0 | 34.324 |
| 16 | 3.5 | 31.4 | 1.50 | 36.96 | 55.3 | 34.854 |
| 17 | 3.8 | 31.6 | 1.54 | 38.10 | 58.7 | 35.368 |
| 18 | 4.0 | 31.9 | 1.58 | 39.20 | 62.1 | 35.866 |

80

FIG. 6

WIDEBAND ANTENNA ARRAY

BACKGROUND

1. Technical Field

The present disclosure relates generally to antenna arrays and more specifically to wideband antenna arrays configured to provide increased performance over a wide operating spectrum.

2. Description of Related Art

Directive antenna systems generally fall into two categories, single directive antennas and antenna arrays. For applications including large operating spectrums, single directive antennas are sometimes preferable to arrays because the performance of a typical array degrades as the size of the operating spectrum increases. For aircraft applications, however, single directive antennas are sometimes impractical due to their comparatively large size and weight, and due to the need to raise or lower the antenna from the airframe when it is in use to enable mechanical scanning. For all applications single directive antennas also have the added drawback that they can only "see" in one direction at a time and they are limited in the rate at which they can steer the beam to new locations. If a malicious (jamming) signal is detected, a single directive antenna must then avoid scanning in the area of the malicious signal altogether.

SUMMARY

The embodiments of the present wideband antenna array have several features, no single one of which is solely responsible for their desirable attributes. Without limiting the scope of the present embodiments as expressed by the claims that follow their more prominent features now will be discussed briefly. After considering this discussion, and particularly after reading the section entitled "Detailed Description", one will understand how the features of the present embodiments provide advantages, which include easy scalability, broadband performance while allowing for incremental degradation and providing no single-path failure points, the ability to scan in two spatial regions simultaneously with a two-beam operation or switch between two regions quickly with a single-beam operation the ability to cover 240° of azimuth scan in a 120° per side switched detection configuration an inexpensive linear array configuration and easy modification to fit the needs of many system requirements, including, but not limited to: transmit and/or receive operations, RADAR, space/time adaptive processing, multiple beams, and higher gain applications.

One aspect of the present wideband antenna array comprises the realization that for certain applications, such as aboard aircraft, wideband antenna arrays are more practical than single directive antennas. For these applications there is a need to improve the performance of wideband antenna arrays particularly the low band performance. There is also a need to improve the ability of wideband antenna arrays to scan over wide azimuths. Currently there exists no broadband antenna system that is suitable for operation aboard aircraft that can achieve multiple beams of operation, fast scanning characteristics and adaptive nulling.

One embodiment of the present wideband antenna array comprises a plurality of antenna element cards. The cards include a plurality of first radiators and a plurality of second radiators. The first radiators are configured to operate in a low band portion of the array's operating spectrum, and the second radiators are configured to operate in a high-band portion of the array's operating spectrum.

Another embodiment of the present wideband antenna array comprises a plurality of antenna element cards. At least one of the cards includes a pair of radiators. The radiators in the pair are oriented in substantially opposite directions.

Another embodiment of the present wideband antenna array comprises a first plurality of antenna element cards. Each card includes at least a first radiator a second radiator and electronics for controlling both the first and second radiators. The array further comprises a second plurality of antenna element cards. Each card includes at least a first radiator, a second radiator and electronics for controlling only one of the first and second radiators. Each of the first radiators is configured to operate in a low band portion of the operating spectrum, and each of the second radiators is configured to operate in a high-band portion of the operating spectrum.

The features, functions, and advantages of the present embodiments can be achieved independently in various embodiments, or may be combined in yet other embodiments.

BRIEF DESCRIPTION OF THE DRAWINGS

The embodiments of the present wideband antenna array now will be discussed in detail with an emphasis on highlighting the advantageous features. These embodiments depict the novel and non-obvious antenna array shown in the accompanying drawings which are for illustrative purposes only. These drawings include the following figures in which like numerals indicate like parts:

FIG. 6 is a chart illustrating simulated results of the performance of a typical seven-hundred sixty-eight element array operating in the 1-18 GHz spectrum.

DETAILED DESCRIPTION

Figure 1:
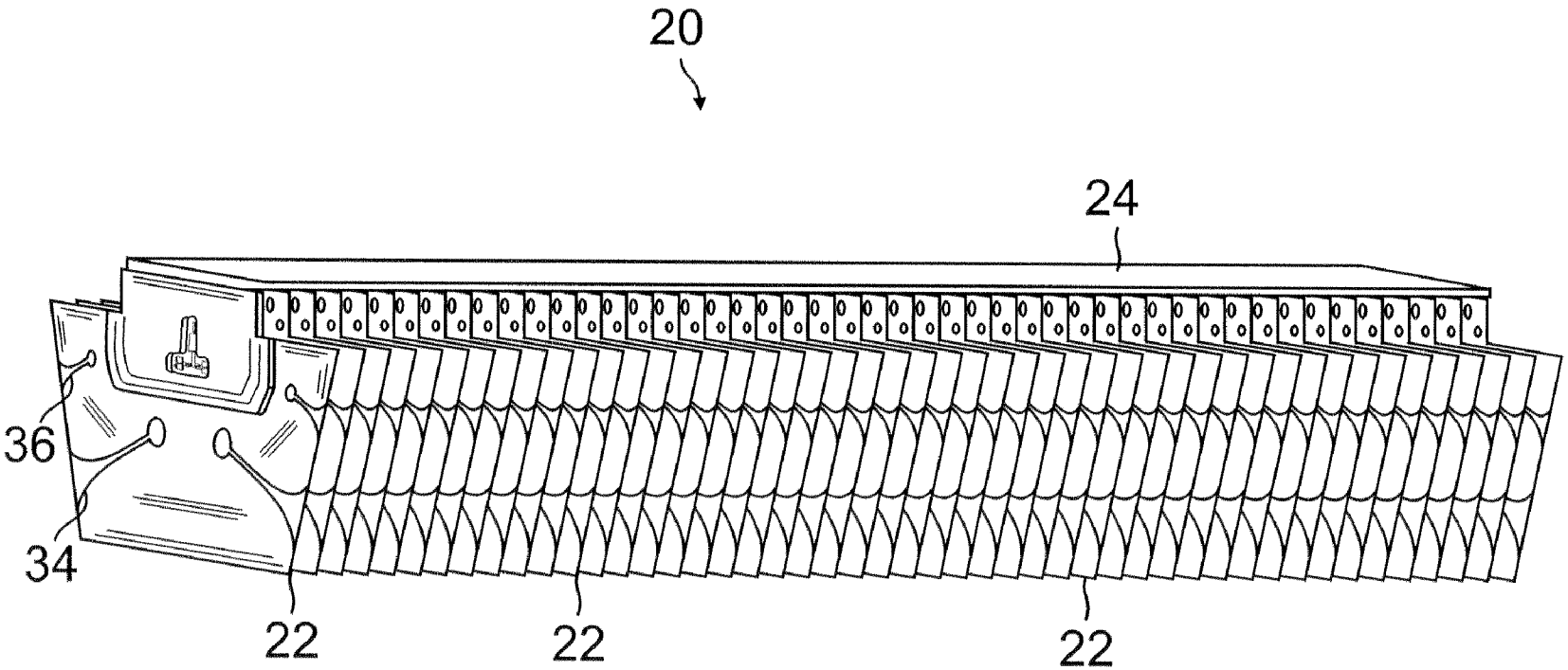
FIG. 1 is a front perspective view of an antenna array including a plurality of antenna element cards according to the present embodiments.

In the detailed description that follows, the present embodiments are described with reference to the drawings. In the drawings, elements of the present embodiments are labeled with reference numbers. These reference numbers are reproduced below in connection with the discussion of the corresponding drawing features.

FIG. 1 illustrates an antenna array 20 including a plurality of antenna element cards 22 according to the present embodiments. The array 20 operates within a given spectrum, which in certain embodiments may be a wideband spectrum. For example, the operating spectrum of the array 20 may be 1-18 GHz.

In the illustrated embodiment, all antenna element cards 22 are substantially parallel to one another and arranged in a linear fashion. Each card 22 is connected to a backplane 24. The backplane 24 serves as a structural member that locates and supports each card 22 at the desired position and orientation. The backplane 24 also distributes digital signals to the element cards 22 and combines radiofrequency (RF) energy from the element cards 22. The backplane 24 may also evacuate the heat generated by chipsets on the element cards 22. The cards 22 are spaced from one another along the backplane 24 an appropriate distance determined according to the operating spectrum of the array 20, according to well-known techniques in the art. The cards 22 may be constructed of any suitable materials, including inexpensive microwave laminate materials.

While the embodiment illustrated in FIG. 1 is referred to herein as an array 20, it could in fact comprise a subarray of a larger array. In the present specification and claims the words array and subarray are synonymous except where the context indicates that one or the other is clearly intended. Further while the illustrated array/subarray 20 includes forty-eight element cards 22, those of ordinary skill in the art will appreciate that arrays according to the present embodiments could include any number of cards 22 and could be made up of any number of subarrays. For example, one embodiment of the present array 20 may include sixteen subarrays of forty-eight element cards 22 each for a total of seven-hundred sixty-eight cards 22.

In the illustrated embodiment, each of the element cards 22 is substantially identical. The cards 22 are thus interchangeable. In certain embodiments each card 22 may comprise a field-replaceable unit (FRU). Malfunctioning FRUs can be quickly removed from the backplane and replaced in the field with functioning cards 22 to restore the performance of the overall array 20. Because the cards 22 are interchangeable a single supply of cards 22 can provide the spare parts necessary to replace malfunctioning FRUs. There is no need to maintain multiple supplies of different card types. Those of ordinary skill in the art will appreciate that in certain alternative embodiments all element cards may not be substantially identical. Examples of such alternative embodiments are described below.

Figure 2:
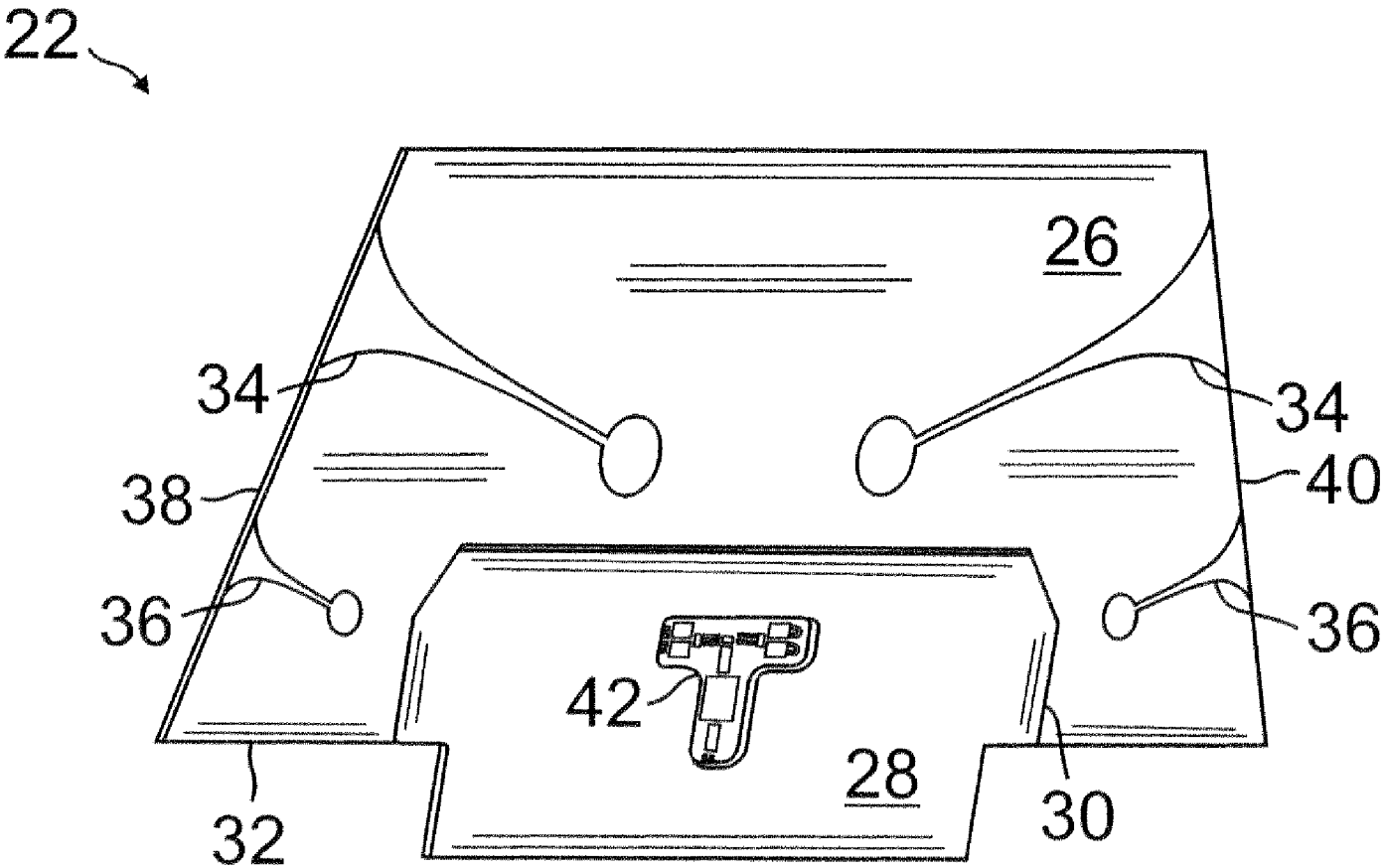
FIG. 2 is a top perspective view of an antenna element card according to the present embodiments.

FIG. 2 illustrates an antenna element card 22 according to the present embodiments. The illustrated card 22 is a substantially flat plate having a first portion 26 and a second portion 28. The first portion 26 is shaped substantially as a trapezoid and the second portion 28 is shaped substantially as a T, with the crossbar 30 of the T overlapping the longer parallel edge 32 of the trapezoidal first portion 26. Those of ordinary skill in the art will appreciate that embodiments of the present antenna element card 22 could have any shape, and the illustrated shape is not to be interpreted as limiting.

With continued reference to FIG. 2, the first portion 26 of the present antenna element card 22 includes a pair of first radiators 34 and a pair of second radiators 36. Those of ordinary skill in the art will appreciate that certain of the present embodiments may not include first and second radiator pairs. For example, certain embodiments may include only one radiator pair, or more than two radiator pairs. Further embodiments may include only a single radiator, or multiple radiators that are not arranged in pairs.

In the embodiment of FIG. 2, the first radiators 34 are configured to operate in a low band portion of the array's operating spectrum, while the second radiators 36 are configured to operate in a high band portion of the array's operating spectrum. In the non-limiting example provided above in which the operating spectrum of the array 20 may be 1-18 GHz, the first radiators 34 may for example operate between 1 GHz and 6 GHz and the second radiators 36 may for example operate between 6 GHz and 18 GHz. Those of ordinary skill in the art will appreciate that the operating spectrums of the array 20, the first radiators 34 and the second radiators 36 may be different from the example just provided. Advantageously, however, the first and second radiators 34, 36 may cover the entire operating spectrum of the array 20 with no gaps.

In the illustrated embodiment, the radiators 34, 36 in each radiator pair are oriented in substantially opposite directions. Each radiator pair extends from an interior of the card 22 to opposite edges 38, 40. With reference to FIG. 1, the orientations of the radiators 34. 36 on the cards 22 enables the array 20 to achieve near-hemispherical coverage. This near-hemispherical coverage greatly enhances the speed with which the present array 20 can scan a given area. In certain embodiments the radiators 34, 36 may be configured for switchable side scan coverage to enable near-full azimuth scan coverage. Those of ordinary skill in the art will appreciate, however, that the illustrated orientations of the radiators 34. 36 are merely one example. Certain embodiments of the present antenna array 20 may not include oppositely oriented radiator pairs. Those of ordinary skill in the art will also appreciate that the illustrated locations of the radiators 34, 36 are only one example.

In the embodiment of the present antenna array 20 shown in FIG. 1, each antenna element card 22 includes a pair of low band radiators 34 and a pair of high band radiators 36. In certain other embodiments, however, low band radiators 34 and high band radiators 36 may be differently distributed across the cards 22 in the array 20. For example, one embodiment of the present array 20 (not shown) may include some cards 22 having only low band radiators 34 and some cards 22 having only high band radiators 36.

In certain other embodiments of the array 20, some or all of the cards 22 may include more than two radiator pairs. For example, some or all of the cards 22 may include a first low band pair, a second midrange pair and a third high band pair. In still further embodiments some or all of the cards 22 may include only one radiator pair.

In the embodiment of the present antenna element card 2 illustrated in FIG. 2, each of the radiators 34, 36 is a Vivaldi antenna. However, those of ordinary skill in the art will appreciate that the radiators 34, 36 in the present embodiments may have other configurations.

Figure 3:
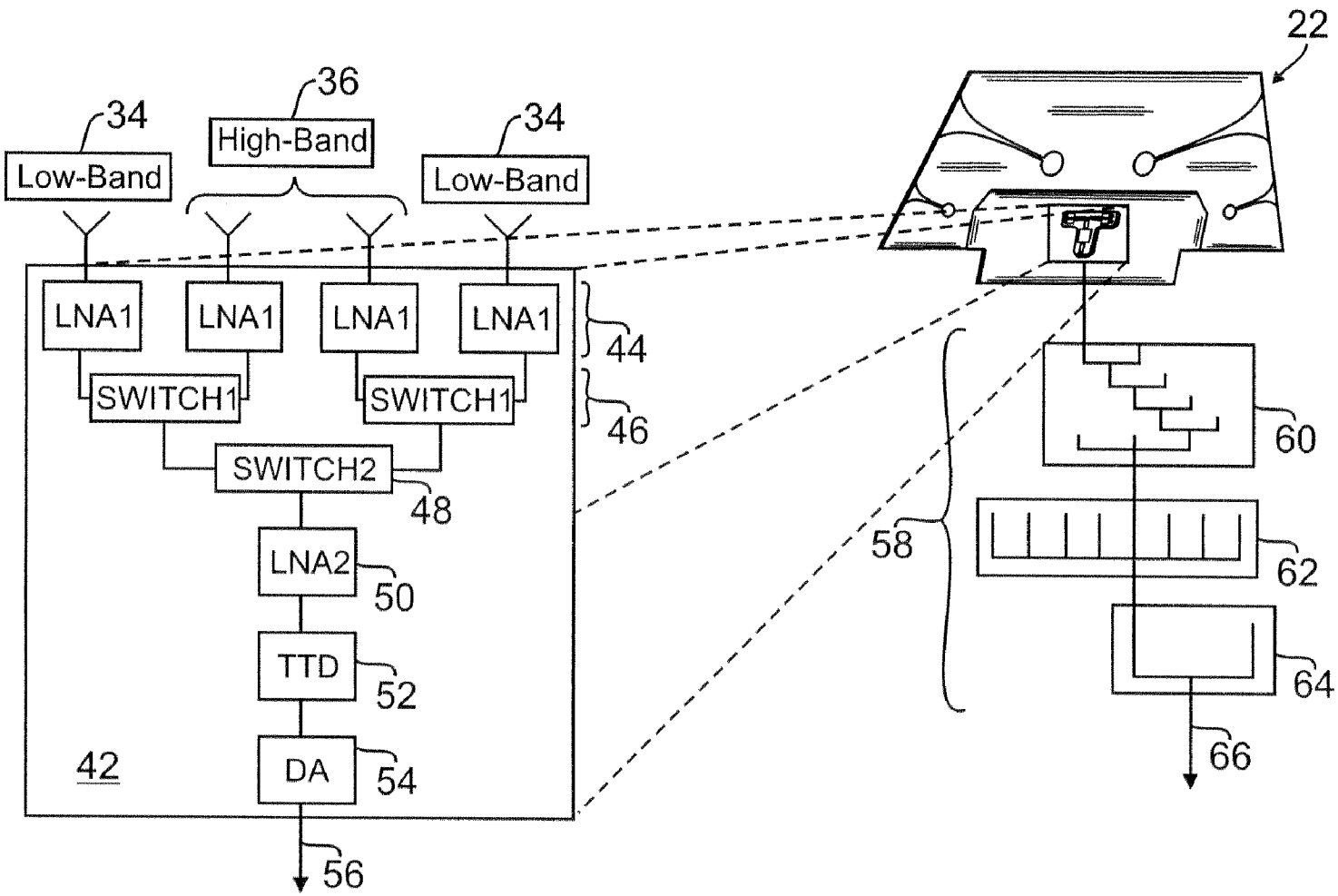
FIG. 3 is a schematic view of one embodiment of electronics for controlling the antenna element card of FIG. 2.

With reference to FIG. 2, the second portion 28 of the illustrated embodiment of the present element card 22 includes active electronics 42 to enable the array 20 to perform the functions of an active electronically scanned array (AESA). In certain embodiments the electronics 42 may comprise a low cost Chip-On-Board (COB) configuration or a Chip-Carrier-On-Board configuration. FIG. 3 illustrates, schematically, one embodiment of Commercial Off The Shelf (COTS) electronics 42 for controlling the antenna element card 22 of FIG. 2. As those of ordinary skill in the art will appreciate, the COTS electronics 42 shown in FIG. 3 are configured for a receive operation.

With reference to FIG. 3, signals are received by the low band radiators 34 and the high band radiators 36. The signals pass through a first low noise gain stage 44, which amplifies the signals while adding little noise of its own. First and second frequency band switches 46 enable the electronics 49 to switch between the low band radiators 34 and the high band radiators 36. A directional switch 48 enables the electronics 42 to switch between radiators located to a first side of the array 20 and radiators located to a second side of the array 20. With reference back to FIG. 2, the oppositely oriented radiator pairs 34, 36 enable signals to be received from and transmitted to opposite sides of the array 20. Those of ordinary skill in the art will appreciate that the directional switch 48 could be replaced with a combiner circuit that has a substantially large enough bandwidth to combine both the signal from the high-band radiators 36 and the low-band radiators 34 to enable simultaneous side coverage.

With continued reference to FIG. 3, the signals pass next through a second low noise gain stage 50 and then through true time-delay circuitry 52. The time-delay circuitry 52 enables the array beam to be steered in desired directions according to principles well-known in the art. The signals pass next through a driver amplifier 54, which amplifies the signals to produce an output signal 56 for a combiner network 58. The combiner network 58 is shown schematically on the right-hand side of FIG. 3 for the aforementioned seven-hundred sixty-eight element array embodiment. The illustrated combiner network 58 assumes that the array/subarray 20 includes forty-eight element cards 22. However, those of ordinary skill in the art will appreciate that embodiments of the present array/subarray 20 may include any number of element cards 22.

With continued reference to FIG. 3, the output signals from the forty-eight element cards 22 pass first through a 48×1 backplane combiner 60, which may be generally constructed out of industry standard printed wiring board standards. The output from the 48×1 backplane combiner 60 passes next through an 8×1 combiner 62 and finally through a 2×1 combiner 64. The 8×1 and 2×1 combiners 62, 64 may be, for example, coaxial combiners. Depending on the system signal level requirements, intermediary amplification can be inserted between the 48×1 backplane combiner 60 and the 8×1 combiner 62 and/or between the 8×1 combiner 62 and the 2×1 combiner 64. An output 66 from the 2×1 combiner is sent to a processor (not shown).

Embodiments of the present array 20, including the electronics 42 described above, easily integrate multiple-beam operation and with some modification could easily allow for more advanced processing techniques, such as space time adaptive processing. Those of ordinary skill in the art will appreciate, however, that the electronics 42 described above are only one example of electronics that could be used with the present array 20. None of the components shown in FIG. 3 should be interpreted as essential to the operation of the present array 20. A multitude of substitute components are available, as those of ordinary skill in the art will appreciate.

Figure 4:
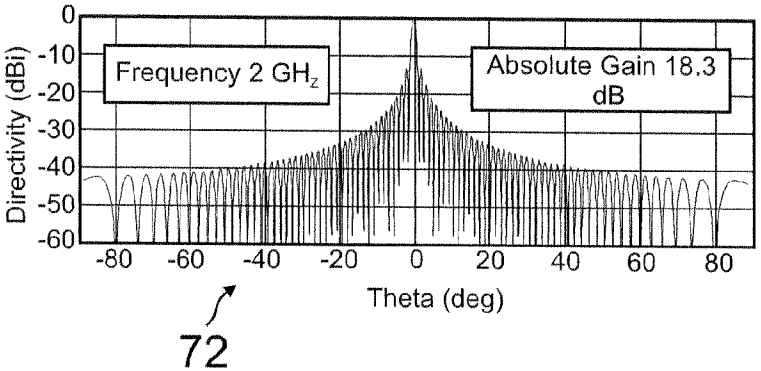
FIG. 4 is a chart and graphs illustrating simulated results of the low band performance of a seven-hundred sixty-eight element array using every other element according to the present embodiments.
Figure 4:
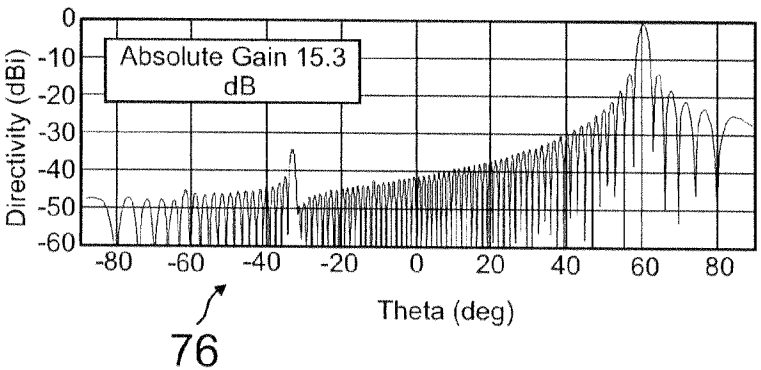
Figure 5:
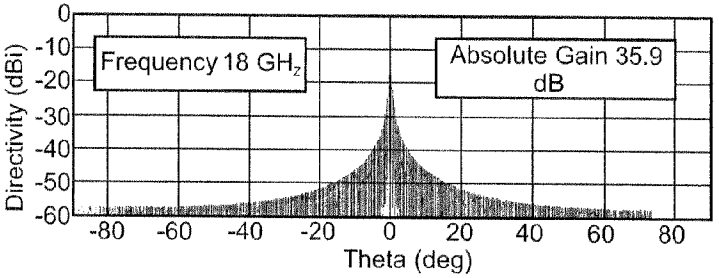
FIG. 5 is a chart and graphs illustrating simulated results of the high band performance of a seven-hundred sixty-eight element array using every element according to the present embodiments.
Figure 5:
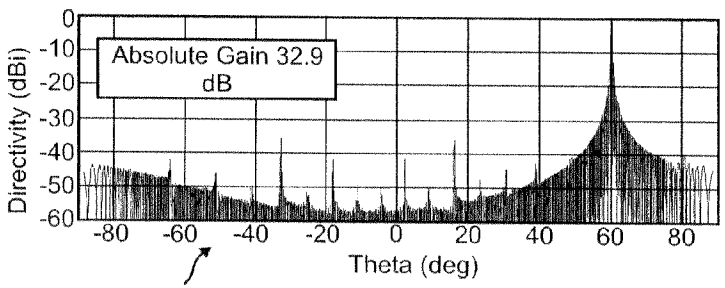

In certain embodiments of the present array 20, not every card 22 in the array 20 includes electronics for controlling the low band radiators 34. For example, in one embodiment only every other card 22 includes electronics for controlling the low band radiators 34. Omitting half of the electronics for controlling the low band radiators 34 allows certain embodiments of the present array 20 to achieve significant cost savings while still realizing exceptional performance due to the reduced requirements for element spacing at lower frequencies. FIGS. 4 and 5 illustrate, in charts 68, 70 and graphs 72, 74, 76, 78, simulated results of the performance of a seven-hundred sixty-eight element array 20 having features in accordance with the present embodiments. FIG. 4 illustrates the simulated results of the low band performance, while FIG. 5 illustrates the simulated results of the high band performance. In FIGS. 4 and 5, the upper graphs 72, 74 illustrate the array performance with the beam pointed at 0°, while the lower graphs 76, 78 illustrate the array performance with the beam pointed at 60°. In the simulation illustrated in FIGS. 4 and 5, the seven-hundred sixty-eight element array 20 includes control electronics for the low band on only every other element card and control electronics for the high band on every element card.

With reference to the chart 68 of FIG. 4, the seven-hundred sixty-eight element array 20 configuration provides advantageously high gain at the lower frequencies. For comparison, FIG. 6 illustrates a chart 80 including simulated results of the performance of a typical seven-hundred sixty-eight element array operating in the 1-18 GHz spectrum. The array represented in FIG. 6 includes seven-hundred sixty-eight radiators, with each radiator operating over the entire 1-18 GHz spectrum. The absolute array gain numbers in FIG. 6 show an exponential drop off in performance at the low end of the spectrum. These performance numbers are in stark contrast to the superior low end performance numbers for the present array 20 shown in the chart 68 of FIG. 4. For example, at 1 GHz the present array 20 provides an absolute array gain of 18.323 dB, while the array of FIG. 6 provides an absolute array gain of −1.067 dB. At 2 GHz the present array 20 provides an absolute array gain of 22.329 dB, while the array of FIG. 6 provides an absolute array gain of only 7.959 dB.

As illustrated above, embodiments of the present antenna array 20 achieve significant advantages over prior art configurations. For example, the array 20 can be easily scaled to meet the specific gain requirements of a given system by adding or removing element cards 22 and/or subarrays. In addition, the federated configuration of the array 20 achieves broadband performance while allowing for incremental degradation and providing no single-path failure points. If a particular piece of electronics 42 fails, the array 20 is still functional with only a minor impact on performance proportional with the size of the array 20. Advantageously, this federated approach is transparent to the user since the response is combined and only a single output is provided to the backend system. The backend system may be related to, for example, transmit and/or receive operations, RADAR, etc.

Embodiments of the present antenna array 20 enable fast scanning in two spatial regions simultaneously with a two-beam operation, or switching between two regions quickly with a single-beam operation. Embodiments of the array 20 maintain an inexpensive linear array configuration. Embodiments of the array 20 allow for 240° of azimuth scan in a 120° per side switched detection configuration. In an aircraft application, this configuration allows fast scanning with both port and starboard scan coverage for detection and/or ranging over the full bandwidth, which in the example above may be 17 GHz. Advantageously, embodiments of the present antenna array 20 can be easily modified to fit the needs of many system requirements including, but not limited to: transmit and/or receive operations, RADAR, space/time adaptive processing, adaptive nulling, multiple beams, and higher gain applications.

The above description presents the best mode contemplated for carrying out the present wideband antenna array, and of the manner and process of making and using it in such full, clear, concise, and exact terms as to enable any person skilled in the art to which it pertains to make and use this antenna array. This antenna array is, however, susceptible to modifications and alternate constructions from that discussed above that are fully equivalent. Consequently, this antenna array is not limited to the particular embodiments disclosed. On the contrary, this antenna array covers all modifications and alternate constructions coming within the spirit and scope of the antenna array as generally expressed by the following claims, which particularly point out and distinctly claim the subject matter of the antenna array.

What is claimed is:

1. A wideband antenna array having an operating spectrum, the array comprising:

a plurality of antenna element cards, the cards including a plurality of first radiators and a plurality of second radiators;

wherein the first radiators are configured to operate in a low band portion of the operating spectrum, and the second radiators are configured to operate in a high-band portion of the operating spectrum;

wherein the low band portion and the high-band portion cover substantially the entire operating spectrum with no gaps; and wherein at least one of the cards includes a pair of the same first radiators and a pair of the same second radiators.

2. The array of claim 1, wherein at least one of the cards includes at least one of the first radiators and at least one of the second radiators.

3. The array of claim 1, wherein each of the plurality of cards includes at least one of the first radiators and at least one of the second radiators.

4. The array of claim 1, wherein the radiators in the first pair are oriented in substantially opposite directions.

5. The array of claim 1, wherein the radiators in the second pair are oriented in substantially opposite directions.

6. The array of claim 1, wherein the antenna element cards are substantially identical and interchangeable.

7. The array of claim 1, wherein a first subset of the cards includes electronics for controlling only the second radiators, and a second subset of the cards includes electronics for controlling both the first and the second radiators.

8. The array of claim 7, wherein the cards from the first and second subsets are arranged in alternating fashion.

9. The array of claim 4 wherein each radiator pair extends from an interior of the card to an opposite edge of the card.

10. The array of claim 1 wherein at least one radiator is configured for switchable side scan coverage so as to enable substantially full azimuth scan coverage.

11. The array of claim 1 wherein at least one card of the array comprises more than two pairs of radiators.

12. The array of claim 11 wherein at least one card of the array comprises a first low band pair of radiators, a second midrange pair of radiators, and a third high band pair of radiators.

13. The array of claim 1 wherein the radiators in at least one card comprise a Vivaldi antenna.

14. The array of claim 1 wherein the array further comprises active electronics to enable active electronically scanned array.

15. The array of claim 1 wherein the array further comprises active electronics configured in one of a chip-on-board configuration or a chip carrier on board configuration.

16. The array of claim 1 wherein substantially every other card includes electronics for controlling the low band radiators.

17. A wideband antenna array having an operating spectrum, the array comprising:

a plurality of antenna element cards, at least one of the cards including a first pair of radiators;

wherein the radiators in the first pair are oriented in substantially opposite directions;

wherein at least one of the cards includes a second pair of radiators;

wherein the second pair of radiators are oriented in substantially opposite directions; and wherein the first pair of radiators is configured to operate in a low band portion of the operating spectrum, and the second pair of radiators is configured to operate in a high-band portion of the operating spectrum.

18. The array of claim 17, wherein the low band portion and the high-band portion cover the entire operating spectrum with no gaps.

19. The array of claim 17, wherein the antenna element cards are substantially identical and interchangeable.

20. The array of claim 17, wherein a first subset of the cards includes electronics for controlling only the second radiators, and a second subset of the cards includes electronics for controlling both the first and the second radiators.

21. The array of claim 20, wherein the cards from the first and second subsets are arranged in alternating fashion.

* * * * *